US010078924B2

(12) United States Patent
Oesterling et al.

(10) Patent No.: US 10,078,924 B2
(45) Date of Patent: Sep. 18, 2018

(54) MAINTENANCE MANAGEMENT FOR VEHICLE-SHARE SYSTEMS

(71) Applicant: GENERAL MOTORS LLC, Detroit, MI (US)

(72) Inventors: Christopher Oesterling, Troy, MI (US); Jessica Renick, Shelby Township, MI (US); Paul Pebbles, Novi, MI (US); Zafar Razzacki, Canton, MI (US)

( * ) Notice: Subject to any disclaimer, the term of this patent is extended or adjusted under 35 U.S.C. 154(b) by 0 days.

(21) Appl. No.: 15/401,178

(22) Filed: Jan. 9, 2017

(65) Prior Publication Data

US 2018/0197349 A1 Jul. 12, 2018

(51) Int. Cl.
*G07C 5/00* (2006.01)

(52) U.S. Cl.
CPC ..... *G07C 5/006* (2013.01)

(58) Field of Classification Search
CPC ..... G07C 5/006; G06F 17/60
See application file for complete search history.

(56) References Cited

U.S. PATENT DOCUMENTS 6,327,900 B1 * 12/2001 McDonald ..... F01M 1/18 701/29.5
7,015,830 B2 * 3/2006 Flick ..... B60R 25/04 340/989
7,451,005 B2 * 11/2008 Hoffberg ..... G05B 15/02 700/83
9,420,405 B2 * 8/2016 Ahmed ..... H04W 4/80
9,807,547 B1 * 10/2017 Oesterling ..... H04W 4/80
2002/0065698 A1 * 5/2002 Schick ..... B61L 27/0094 705/7.36
2003/0055666 A1 * 3/2003 Roddy ..... B61L 27/0094 705/305
2003/0225707 A1 * 12/2003 Ehrman ..... G06Q 10/08 705/64
2004/0093155 A1 * 5/2004 Simonds ..... B60R 16/0231 701/532
2004/0185842 A1 * 9/2004 Spaur ..... B60R 25/04 455/420
2008/0147264 A1 * 6/2008 Doulatshahi ..... G06Q 10/06 701/29.5
2010/0152976 A1 * 6/2010 White ..... A61B 5/117 701/48

(Continued)

*Primary Examiner* — Alex C Dunn

(57) ABSTRACT

A system to manage the routine maintenance of a vehicle incorporated in a vehicle-share system is presented herein. The maintenance management system includes a vehicle having a vehicle sensor, vehicle communication platform (VCP), and remote entity. The VCP is located within the vehicle and communicates with the vehicle sensor. The VCP is configured to generate and communicate a data transmission. The remote entity has at least one database and is configured to receive the VCP data transmission. Moreover, the VCP collaborates with the vehicle sensor to generate at least one routine maintenance notice and subsequently transmits the routine maintenance notice to the remote entity. Upon review and analysis of the routine maintenance notice, the remote entity will predict future maintenance of the vehicle and modify the vehicle registration status in the database to allow for a maintenance event.

20 Claims, 7 Drawing Sheets

(56) References Cited

U.S. PATENT DOCUMENTS

| | | | | |
|---|---|---|---|---|
| 2011/0301992 | A1* | 12/2011 | Staaf | G06Q 10/06311 705/7.13 |
| 2013/0141247 | A1* | 6/2013 | Ricci | H04W 4/90 340/870.01 |
| 2013/0295913 | A1* | 11/2013 | Matthews | H04M 1/72577 455/420 |
| 2013/0317694 | A1* | 11/2013 | Merg | G07C 5/008 701/31.6 |
| 2014/0309870 | A1* | 10/2014 | Ricci | H04W 4/21 701/36 |
| 2014/0309891 | A1* | 10/2014 | Ricci | H04W 4/21 701/48 |
| 2015/0105968 | A1* | 4/2015 | Ho | G07C 5/006 701/31.5 |
| 2015/0161832 | A1* | 6/2015 | Esselink | G07C 9/00015 340/5.22 |
| 2016/0093119 | A1* | 3/2016 | Ahn | G07C 5/006 701/29.3 |
| 2016/0203661 | A1 | 7/2016 | Pudar | |
| 2017/0232888 | A1* | 8/2017 | Ricci | H04W 4/21 705/27.1 |

* cited by examiner

MAINTENANCE MANAGEMENT FOR VEHICLE-SHARE SYSTEMS

INTRODUCTION

Renting a vehicle often requires a reservation be made with a rental company and further requires the user physically travel to the rental facility to gain vehicle access. Before access is granted, however, the rental company has to review the vehicle condition to determine whether maintenance is needed. This can be a tedious task for company employees. Renting vehicles through vehicle-share systems provides a viable alternative to the typical vehicle rental systems and requires less employee work. However, the autonomy involved with these vehicle-share systems makes it difficult for the rental company to review the vehicle condition and determine when maintenance is needed. It is therefore desirable for vehicle-share systems to enable their vehicles to notify of their maintenance needs.

SUMMARY

A system to manage the routine maintenance of a vehicle incorporated in a vehicle-share system is presented herein. The maintenance management system includes a vehicle having a vehicle sensor, vehicle communication platform (VCP), and remote entity. The VCP is located within the vehicle and communicates with the vehicle sensor. The VCP is configured to generate and communicate a data transmission. The remote entity has at least one database and is configured to receive the VCP data transmission. Moreover, the VCP collaborates with the vehicle sensor to generate at least one routine maintenance notice and subsequently transmits the routine maintenance notice to the remote entity. Upon review and analysis of the routine maintenance notice, the remote entity will predict future maintenance of the vehicle and modify the vehicle registration status in the database to allow for a maintenance event.

In certain instances, the maintenance management system includes a maintenance facility configured to provide routine vehicle maintenance services. Moreover, the remote entity may generate and transmit a maintenance notification to the maintenance facility to schedule the maintenance event at the maintenance facility. In other instances, the maintenance management system includes a GNSS chipset/component and a plurality of maintenance facilities, each of which being configured to provide routine vehicle maintenance services. Moreover, in this instance, the VCP collaborates with the GNSS chipset/component to generate at least one vehicle location notice, the VCP subsequently transmits the vehicle location notice to the remote entity. Upon review and analysis of the vehicle location notice and routine maintenance notice, the remote entity will select one of the plurality of maintenance facilities, generate a maintenance notification, and transmit the maintenance notification to the selected maintenance facility to schedule the maintenance event at the selected maintenance facility.

In further instances, the maintenance management system includes a mobile computing device with an installed CarShare App. In such instances, the remote entity generates and transmits an out-of-service notification to the CarShare App. The remote entity may otherwise generate and transmit an out-of-service notification to the VCP. The out-of-service notification may include an incentive offer. The routine maintenance notice may include remaining oil time/quantity information, oil filter failure information, component failure information, self-diagnostic information, mileage information, or some combination thereof. The maintenance notification may include vehicle oil life information, vehicle oil filter health information, malfunction indicator lamp initiation, mileage information, vehicle component failure, self-diagnostic notification, or some combination thereof.

A method to manage the routine maintenance of a vehicle incorporated in a vehicle-share system is also presented herein. The maintenance management method includes the steps of: (a) providing a vehicle comprising at least one vehicle sensor; (b) providing a vehicle communication platform (VCP) located within the vehicle, the VCP configured to communicate with the vehicle sensor, the VCP configured to generate and communicate at least one data transmission; (c) providing a remote entity comprising a database, the remote entity configured to receive the VCP data transmission; (d) receiving, at the VCP, at least one communication from the vehicle sensor; (e) generating, via the VCP, at least one routine maintenance notice derived from the vehicle sensor communication; (f) transmitting, via the VCP, the routine maintenance notice to the remote entity; (g) receiving, at the remote entity, the routine maintenance notice; (h) implementing a back-end function, via the remote entity, to review and analyze the routine maintenance notice; (i) predicting, via the remote entity, future maintenance of the vehicle from the routine maintenance notice analysis; and (j) modifying, via the remote entity, the vehicle registration status in the database to allow for a maintenance event.

BRIEF DESCRIPTION OF THE DRAWINGS

The disclosed examples will hereinafter be described in conjunction with the following drawing figures, wherein like numerals denote like elements, and wherein.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the exemplary aspects of the present disclosure. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

The figures disclosed herein are not necessarily to scale; some features could be exaggerated or minimized to show details of particular components. Therefore, specific structural and functional details disclosed herein are not to be interpreted as limiting, but merely as a representative basis for teaching one skilled in the art to variously employ the exemplary aspects of the present disclosure. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Vehicle-share services (self-serve rental services) allow consumers to make reservations for station based round trip use of vehicles, particularly in urban environments. These rental vehicles are often located in reserved parking spaces identified with permanently mounted signs or markers. Ideally, a user acquires a vehicle from a reserved parking space and returns the vehicle to the same parking space, or an otherwise similarly marked space. It may also be desirable to provide systems for monitoring a parking space; for example, erecting smart signs that can detect when authorized or unauthorized vehicle is parked in the parking space as well as notify the user or rental company.

Figure 1:
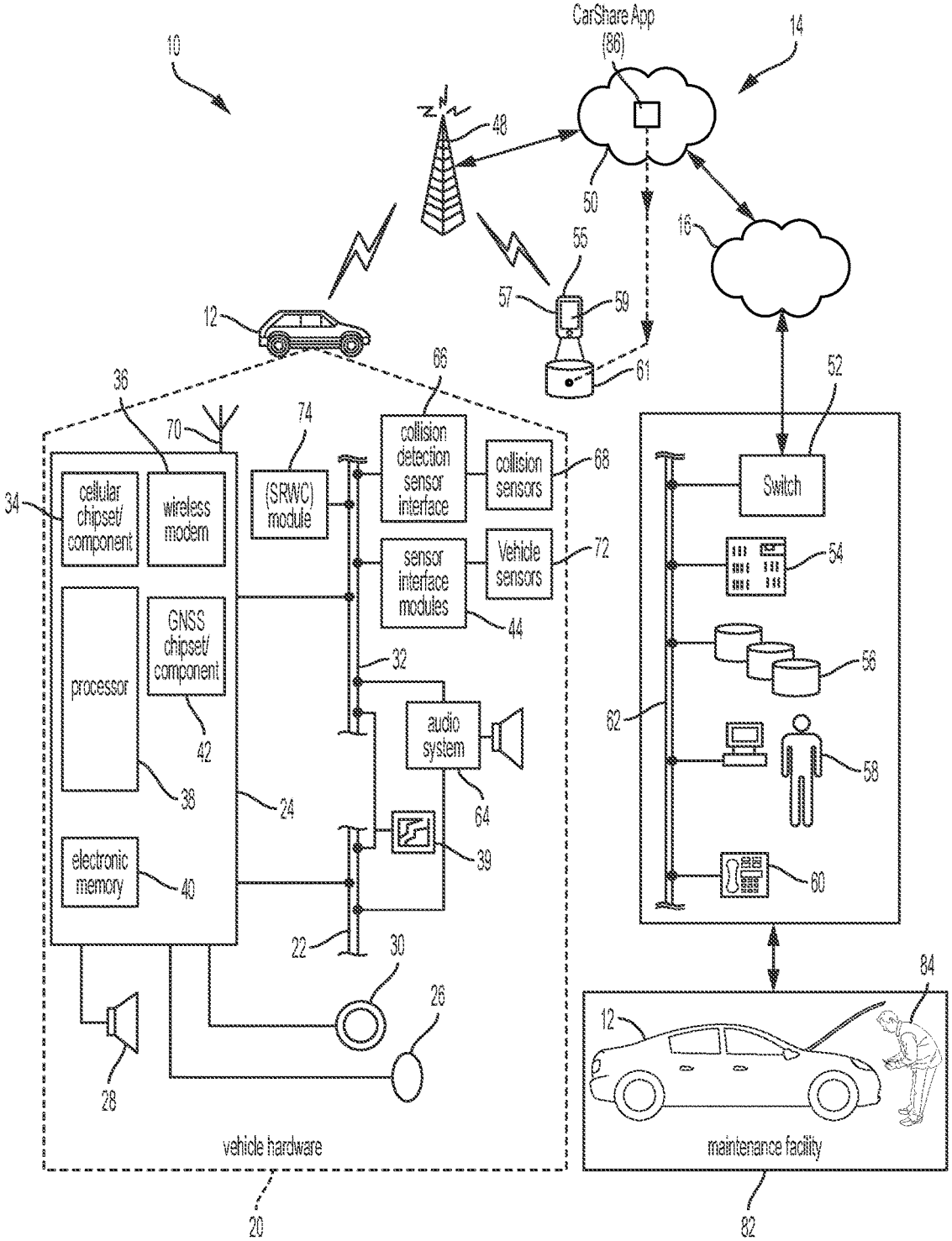
FIG. 1 is a diagram illustrating a non-limiting example of a communication environment for an exemplary system presented herein.

With reference to FIG. 1, there is shown a non-limiting example of an environment for communication system 10 that may be used together with examples of the vehicle-share system disclosed herein or to implement examples of the methods disclosed herein. Communication system 10 generally includes a vehicle 12, a wireless carrier system 50, a land network 16 a call center 18, and a system of maintenance facilities 82 (shown as one). It should be appreciated that the overall architecture, setup, and operation, as well as the individual components of the illustrated system are merely exemplary and that differently configured communication systems may also be utilized to implement the examples of the method disclosed herein. Thus, the following paragraphs, which provide a brief overview of the illustrated communication system 10, are not intended to be limiting.

Vehicle 12 may be any type of mobile vehicle such as a motorcycle, car, truck, recreational vehicle (RV), boat, plane, etc., and is equipped with suitable hardware and software that enables it to communicate over communication system 10. Some of the vehicle hardware 20 is shown generally in FIG. 1 including a telematics unit 24, a microphone 26, a speaker 28, buttons and/or controls 30 (connected to the telematics unit 24), and various vehicle systems such as, but not limited to, vehicle crash and/or collision detection sensor interface 66 and sensor interface modules 44. Operatively coupled to the telematics unit 24 is a network connection or vehicle bus 32. Examples of suitable network connections include a controller area network (CAN), a media oriented system transfer (MOST), a local interconnection network (LIN), an Ethernet, and other appropriate connections such as those that conform with known ISO (International Organization for Standardization), SAE (Society of Automotive Engineers), and/or IEEE (Institute of Electrical and Electronics Engineers) standards and specifications, to name a few.

The telematics unit 24 is an onboard vehicle communication platform (herein after "VCP") that provides a variety of services through its communications with the remotely located call center 18, and generally includes an electronic processing device 38, one or more types of electronic memory 40, a cellular chipset/component 34, a wireless modem 36, a dual-mode antenna 70, and a navigation unit containing a GNSS chipset/component 42. In one example, the wireless modem 36 includes a computer program and/or code segment (software algorithm) adapted to be executed within electronic processing device 38.

VCP 24 may provide various services including: turn-by-turn directions, in-vehicle voice messaging (IVVM), and other navigation-related services provided in conjunction with the GNSS chipset/component 42; airbag deployment notification and other emergency or roadside assistance-related services provided in connection with various crash and/or collision sensor interface modules 66 and collision sensors 68 located throughout the vehicle; and/or infotainment-related services where music, internet web pages, movies, television programs, videogames, and/or other content are downloaded by an infotainment center 46, operatively connected to VCP 24 via vehicle bus 32 and audio bus 22. In one example, downloaded content is stored for current or later playback. The above-listed services are by no means an exhaustive list of all the capabilities of VCP 24, but are simply an illustration of some of the services that VCP 24 may be capable of offering. It is anticipated that VCP 24 may include a number of additional components in addition to and/or different components from those listed above and may collaborate with one or more additional features of communication system 10 to achieve its capabilities.

Vehicle communications may use radio transmissions to establish a voice channel with wireless carrier system 14 so that both voice and data transmissions can be sent and received over the voice channel. Vehicle communications are enabled via the cellular chipset/component 34 for voice communications and the wireless modem 36 for data transmission. Any suitable encoding or modulation technique may be used with the present examples, including digital transmission technologies, such as TDMA (time division multiple access), CDMA (code division multiple access), W-CDMA (wideband CDMA), FDMA (frequency division multiple access), OFDMA (orthogonal frequency division multiple access), etc.

Dual mode antenna 70 services the GNSS chipset/component 42 and the cellular chipset/component 34. Amongst other functions, GNSS chipset/component 42 provides two-way, real-time data transmissions of geographic positioning information, typically to and from a cluster GPS satellites (not shown) as is generally known.

Visual display 39 is preferably a graphics display, such as a touch screen on the instrument panel, a heads-up display reflected off of the windshield, or as part of the console of infotainment center 46, and can be used to provide a multitude of input and output functions (i.e., capable of GUI implementation).

Microphone 26 provides the driver or other vehicle occupant with a means for inputting verbal or other auditory commands, and can be equipped with an embedded voice processing unit utilizing a human/machine interface (HMI) technology known in the art. Conversely, speaker 28 provides audible output to the vehicle occupants and can be either a stand-alone speaker specifically dedicated for use with VCP 24 (e.g., IVVM) or can be part of a vehicle audio component 64. In either event, microphone 26 and speaker 28 enable vehicle hardware 20 and call center 18 to communicate with the occupants through audible speech. The vehicle hardware also includes one or more buttons and/or controls 30 for enabling a vehicle occupant to activate or engage one or more of the vehicle hardware components 20. For example, one of the buttons and/or controls 30 can be an electronic pushbutton used to initiate voice communication with call center 18 (whether it be a human such as advisor 58 or an automated call response system). In another example, one of the buttons and/or controls 30 can be used to initiate emergency services.

The audio component 64 is operatively connected to the vehicle bus 32 and the audio bus 22. The audio component 64 receives analog information, rendering it as sound, via the audio bus 22. Digital information is received via the vehicle bus 32. The audio component 64 provides amplitude modulated (AM) and frequency modulated (FM) radio, compact disc (CD), digital video disc (DVD), and multimedia functionality independent of the infotainment center 46. Audio component 64 may contain a speaker system, or may utilize speaker 28 via arbitration on vehicle bus 32 and/or audio bus 22.

The vehicle crash and/or collision detection sensor interface 66 is operatively connected to the vehicle bus 32. The collision sensors 68 provide information to VCP 24 via the crash and/or collision detection sensor interface 66 regarding the severity of a vehicle collision, such as the angle of impact and the amount of force sustained.

Vehicle sensors 72, connected to various sensor interface modules 44 are operatively connected to the vehicle bus 32 and monitor various vehicle dynamics. Examples of vehicle sensors include but are not limited to gyroscopes, accelerometers, odometers, milometers, speedometers, OBD systems (e.g., OBD II), magnetometers, fuel tank monitors, oil pan monitors, oil filter monitors, hydraulics monitors, emission detection, and/or control sensors, and the like. As an example, an oil monitoring module (OMM) 44 could provide myriad real-time data regarding various engine aspects relating to aspects of the engine oil including, but not limited to, engine oil life, oil filter health, oil pressure. As another example, a body control module (BCM) 44 could provide for various vehicle functionality including, but not limited to, lock and unlock functionality, trunk or tailgate release, sound horn, turn on/off lights, remote start and engine start/stop functionality during typical communications with RKE or passive systems.

A passive entry passive start (PEPS) module 44 is another example of vehicle sensor module that can be connected to the vehicle bus 32 and provide passive detection of the absence or presence of a passive physical key or a virtual vehicle key (discussed below). The PEPS module 44 can use its own antenna or receive signals via antenna 70. When the passive physical key fob or smart phone 57 with virtual vehicle key approaches, the PEPS module 43 can determine if the passive physical key belongs to the vehicle 12 and/or (in some embodiments) determine if the virtual vehicle key is authorized/authentic. If the virtual vehicle key is authentic, the PEPS module 44 can send a command to the BCM permitting access to the vehicle 12. In other implementations, it is possible for the BCM to carry out the functionality attributed to the PEPS module 44. As is appreciated by those skilled in the art, the above-mentioned VSMs are only examples of some of the sensor modules that may be used in vehicle 12, as numerous others are also possible.

Wireless carrier system 14 may be a cellular telephone system or any other suitable wireless system that transmits signals between the vehicle hardware 20 and land network 16. According to an example, wireless carrier system 14 includes one or more cell towers 48

Land network 16 can be a conventional land-based telecommunications network that is connected to one or more landline telephones, and that connects wireless carrier system 14 to call center 18 and, in certain instances, to maintenance facility 62. For example, land network 16 can include a public switched telephone network (PSTN) and/or an Internet Protocol (IP) network, as is appreciated by those skilled in the art. Of course, one or more segments of the land network 16 can be implemented in the form of a standard wired network, a fiber or other optical network, a cable network, other wireless networks such as wireless local networks (WLANs) or networks providing broadband wireless access (BWA), or any combination thereof.

One of the networked devices that can communicate with VCP 24 is a mobile computing device 57, such as a smart phone, wearable computing device such as a smart watch or smart glasses and having two-way communication capabilities, personal laptop computer or tablet computer having two-way communication capabilities, a netbook computer, or any suitable combinations thereof. The mobile computing device 57 can include computer processing capability through a mobile processing device (mobile processor), a transceiver capable of communicating with wireless carrier system 14 to send and, mobile memory storage 61, digital camera 55, a user interface 59, and/or a GPS module capable of receiving GPS satellite signals and generating GPS coordinates based on those signals. User interface 59 may be embodied as a touch-screen graphical interface capable of user interaction as well as displaying information. Digital camera 55 may include the ability to generate digital images (i.e., digital image information) that are bitmapped data representations of tangible objects captured and stored to memory 61 by operations generally known in the art. Examples of the mobile computing device 57 include smart phones such as the iPhone™ manufactured by Apple, Inc. and the Droid™ manufactured by Motorola, Inc. (as well as others), and wearables such as Apple Watch manufactured by Apple, Inc. (as well as others). While mobile computing device 57 may include the ability to communicate via cellular communications using the wireless carrier system 14, this is not always the case. For instance, Apple manufactures devices such as the various models of the iPad™ and iPod Touch™ that include the processing capability, interface 59, and the ability to communicate over a short-range wireless communication link. However, the iPod Touch™ and some iPads™ do not have cellular communication capabilities. Even so, these and other similar devices may be used or considered a type of wireless device, such as the mobile computing device 57, for the purposes of the system and method described herein.

The mobile computing device 57 may receive one or more software applications to be associated with vehicle 12. For example, the user of mobile device 57 may visit an online software application store or web-service and download a car-sharing software application 86 (hereinafter "CarShare App") therefrom. The mobile computing device 57 may moreover install this CarShare App onto mobile memory storage 61. Upon implementation, the CarShare App 86 may moreover include one or more graphical user interfaces (GUIs) to include one or more prompts which instruct the user to provide information and/or provide one or more commands.

A short-range wireless connection (SRWC) module 74 allows mobile computing device 57 and VCP 24 to pair one with another (or link to one another) when within a wireless range (e.g., prior to experiencing a disconnection from the wireless network), as is generally known in the art. SRWC pairing is known to skilled artisans (e.g., Bluetooth Low Energy). Call center 20 may participate in pairing mobile computing device 57 and VCP 30. For example, for added security, the call center 20 may initiate the inquiry procedure between VCP 24 and mobile computing device 57.

Call center 18 is designed to provide the vehicle hardware 20 with a number of different system back-end functions and, according to the example shown here, generally includes one or more switches 52, remote computing entity 54 (e.g., one or more computer servers), databases 56, advisors 58, as well as a variety of other telecommunication/computer equipment 60. These various components are suitably coupled to one another via a network connection or bus 62, such as the one previously described in connection with the vehicle hardware 20. Switch 52, which can be a private branch exchange (PBX) switch, routes incoming signals so that voice transmissions are usually sent to either advisor 58 or an automated response system, and data transmissions are passed on to a modem or other piece of telecommunication/computer equipment 60 for demodulation and further signal processing. The modem or other telecommunication/computer equipment 60 may include an encoder, as previously explained, and can be connected to various devices such as remote entity 54 and database 56. For example, database 56 could be designed to store subscriber profile records, subscriber behavioral patterns, vehicle reservation calendar information, or any other pertinent subscriber information. The vehicle reservation calendar may, for example, be a code segment executed to create a virtual calendar having numerous designatable time slots to allow users of the vehicle share system to reserve at least one vehicle in the system for a desired time duration. One embodiment of reservation calendar may store the time slot information in a tabular form (spreadsheet).

Although the illustrated example has been described as it would be used in conjunction with a call center 18 that is manned, it will be appreciated that the call center 18 can be any central or remote facility, manned or unmanned, mobile or fixed, to or from which it is desirable to exchange voice and data.

A system of maintenance facilities 82 may be in communication with call center 18, for example, via a network connection or bus 62. Each maintenance facility 82 provides myriad routine maintenance services for each vehicle 12 in the vehicle-share system 10. For instance, based on a distinguishable maintenance event, vehicle 12 may be repaired by technician 84. For example, when OMM recognizes that the remaining engine oil life falls below a certain threshold (e.g., 20%) or the oil filter health fails (e.g., low oil pressure, oil drip, etc.), vehicle 12 may be designated to be brought to the closest facility 82 in the system for the routine maintenance event of an oil change (or other similar service) to alleviate the vehicle issue.

The maintenance facilities 82 may be scattered at selected locations in a specific geographic area. For instance, a maintenance facility 82 in the system may be located in or near an area having a cluster of reservable parking spaces (discussed above). Such a location is convenience for the vehicle 12 to be brought into maintenance facility 82. It should be understood that one of the maintenance facilities 82 may also be incorporated into call center 20. As such, this particular maintenance facility may be in direct connection with remote entity 54 or indirectly be connected to remote entity 54 via a LAN, WLAN, or wireless carrier system 50.

Figure 2:
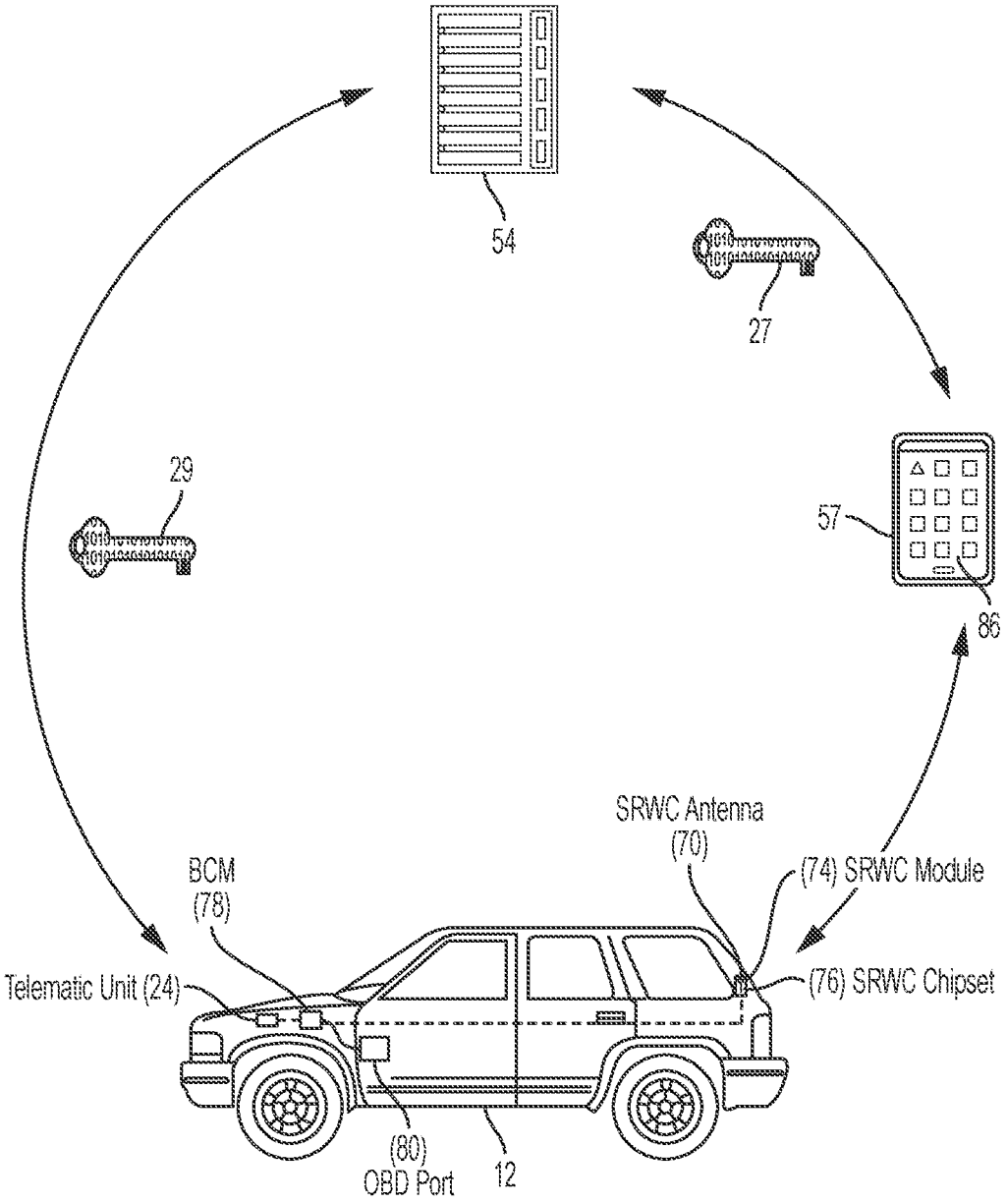
FIG. 2 illustrates a communication flow diagram between communicating entities for a vehicle-share system.

FIG. 2 illustrates communication flow diagram between communicating entities for a vehicle sharing system. The vehicle-share system allows a user to reserve a respective unreserved vehicle through their mobile computing device 57. The vehicle-share system moreover pairs mobile device 57 to the SRWC module 74 of the selected vehicle 12, so that vehicle functions (e.g., vehicle access and operation) may be commanded by mobile computing device 57.

FIG. 2 illustrates the interactions between vehicle 12, mobile device 57, and remote entity 54. The SRWC module 74 may incorporate a SRWC chipset 76 and one or more internal SRWC antennas 70. The vehicle 12 further includes sensor interface module (BCM) 78 and VCP 24, as discussed above. In this embodiment, BCM 78 includes various vehicle functionality including, but not limited to, lock and unlock functionality, trunk or tailgate release, sound horn, vehicle lights flashing configurations, remote start and engine start/stop functionality during typical communications with the Remote Keyless Entry (RKE) or passive systems. VCP 24 enables long distance data transmissions from the SRWC module 74 to the remote entity 54. VCP 24 may also provide a wireless hotspot accessible by the SRWC module 74 as a communication medium that can provide an additional authentication mechanism. In certain embodiments, SRWC module 74 may alternatively include its own long range communication capabilities. It should be appreciated SRWC module 74 may implement wireless communication protocols which include, but are not limited to, a Bluetooth Low Energy (BLE) protocol, a Bluetooth protocol, a ZigBee protocol, an iBeacon protocol, an Eddystone protocol, a near field communication protocol, and/or a Wi-Fi protocol.

In certain embodiments, SRWC module 76 can be embodied as an adaptive hardware-based accessory device which can be releasably coupled to an on-board diagnostic (OBD) port 80. Port 80 (also known as an ALDL port) is a component adapted to connect to one of the on-board diagnostics systems (e.g., OBD II), vehicle sensors 72, and/or sensor interface modules 44 (e.g., OMNI, BCM, etc.) via vehicle bus 32. Port 80 may further include components that can provide its own independent internal inspections and diagnoses of various vehicle systems (e.g., the vehicle power train, suspension, engine, etc.), so as to ensure the vehicle performance conforms to certain standards. In other embodiments, the SRWC module 76 can be independently installed within vehicle 12 and, as a result, communicate directly with the on-board diagnostics systems (e.g., OBD II), vehicle sensors 72, and/or sensor interface modules 44 (e.g., OMNI, BCM, etc.) via vehicle bus 32. It should be appreciated that such an installation may be installed during vehicle manufacture or as part of an aftermarket installation.

SRWC module 74 may additionally include security mechanisms to protect the vehicle against unauthorized usage or theft (e.g., via mechanisms to disable remote keyless functions) without authorization. As follows, SRWC module 76 can replace the need for storing an authorization key in a separate key fob to allow for passive execution of certain vehicle operations. As discussed below, to obtain authorization, the remote entity 54 may issue two encrypted public keys 27 and 29 required to unlock a corresponding digital access token (stored in database 56), which can enable the remote access of certain vehicle systems. The first key 27 may be issued to mobile device 57 and stored thereon. The second key 29 may be issued to SRWC module 76 and stored thereon (or memory 40). The access token may otherwise be stored in memory 40, as described in U.S. Patent Application Publication No. 2016-0203661A1, the entirety of which is hereby incorporated by reference. It should also be understood that other authorization schemes may be utilized, in addition to public key cryptography.

The access token includes an outer layer (the "command request" lawyer), which can be signed by first and second public keys 27, 29 and can verify the keys be comparing their encrypted data. The token additionally includes an inner layer (the "digital key" layer), which includes an unmodified server-signed object and which provides a ClearText package describing the allowed vehicle operations and constraints (allowed time frames, etc.). As follows, when a vehicle-share system user approaches vehicle 12, their mobile computing device 57 may digitally communicate the first key 27 to the SRWC module 74. SRWC module 74 (or processor 38) will then provide both the first and second keys 27, 29 to the access token. The access token may then verify that the first and second keys 27, 29 correspond with each other. When verification is complete, and in conformity with the "digital key" layer parameters, mobile device 57 can indirectly access, communicate with, and command the vehicle systems—the entirety of which is disclosed in U.S. Patent Application Publication No. 2016-0203661A1 (previously incorporated by reference above). Mobile computing device 57 may thus command BCM 44 to operate the lock and unlock functions, engine, and various other vehicle functions. Mobile computing device 57 may moreover communicate with other vehicle systems and receive information to be displayed through the user interface of CarShare App 86.

Figure 3:
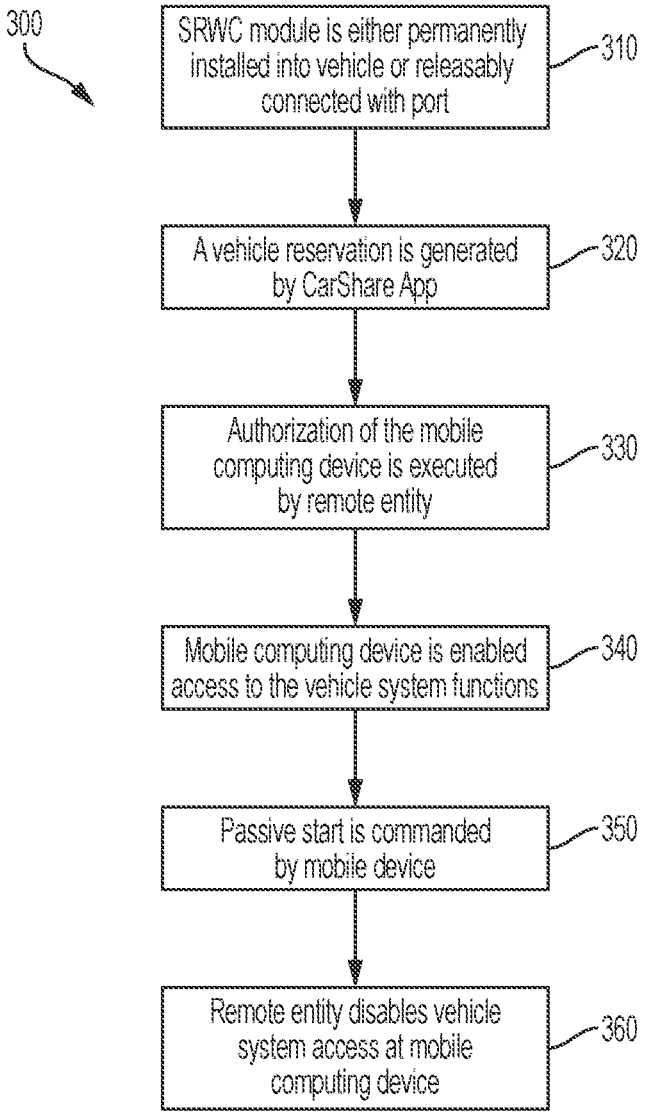
FIG. 3 is a broad overview flowchart for reserving and authorizing use of the vehicle.

FIG. 3 is a broad overview of method 300 for reserving and authorizing use of the vehicle equipped for the vehicle-share system. In step 310, as an initial setup, SRWC module 74 is either permanently installed into vehicle 12 or releasably connected with port 80. In step 320, a vehicle reservation is generated by CarShare App 86 and may reserve a vehicle located at a specific parking location. Various details may be required to complete the vehicle reservation such as, but not limited to, information directed to the mobile device identification (i.e., serial number), user name, and reservation times (e.g., the designated beginning and completion time entries). Mobile device 57 may then transmit the vehicle registration to the remote entity 54 to subsequently validate the vehicle registration. When the vehicle reservation can be validated, remote entity 54 may store the reservation information in database 56 (e.g., a vehicle registration calendar).

In step 330, authorization of the mobile computing device 57 is executed by remote entity 54, as discussed above. In step 340, upon successful authorization, mobile computing device 57 is enabled access to the vehicle system functions. In step 350, passive start (i.e., engine ignition) is commanded by mobile device 57 (i.e., via CarShare App 86). In step 360, upon completion of the vehicle reservation, remote entity 54 disables vehicle system access at mobile computing device 57. In this step, the first and second public keys 27, 29 are wiped clean (i.e., key codes are erased) at both mobile device 57 and vehicle 12.

Figure 4:
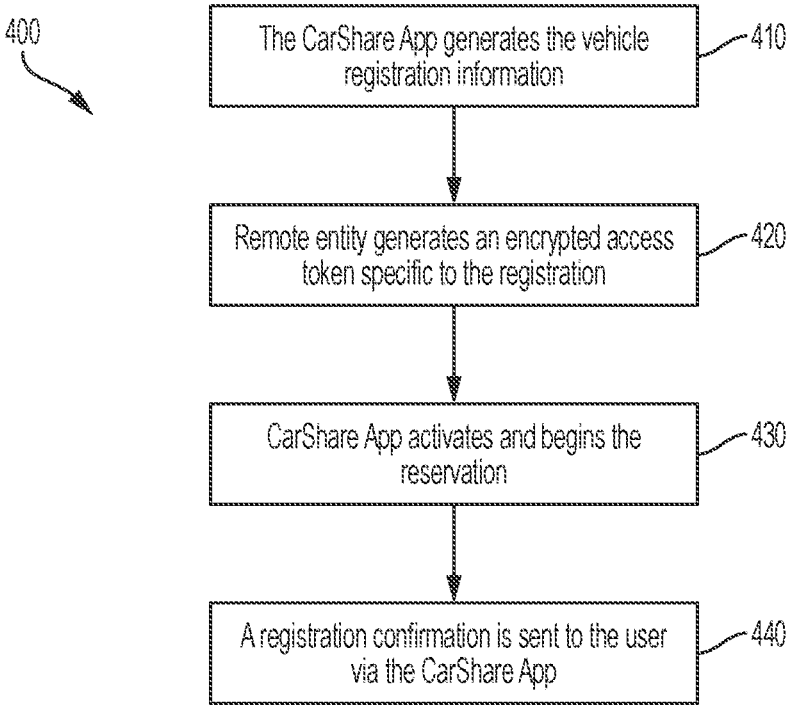
FIG. 4 is a flow diagram for the detection and authorization of a user based on an approaching mobile device.

FIG. 4 represents a flow diagram of method 400 for registration of a reserved vehicle in the vehicle-share system. In step 410, CarShare App 86 generates the vehicle registration information. In step 420, remote entity 54 may generate an encrypted access token specific to the registration. The access token is transmitted to mobile computing device 57 within a predetermined period (e.g., 20 seconds) of time from the registration request. The signed access token may include a SRWC universal unique identifier (UUID), time range, and timestamp. In step 430, CarShare App 86 activates and begins the reservation. In step 440, a registration confirmation is sent to the user via CarShare App 86.

Figure 5:
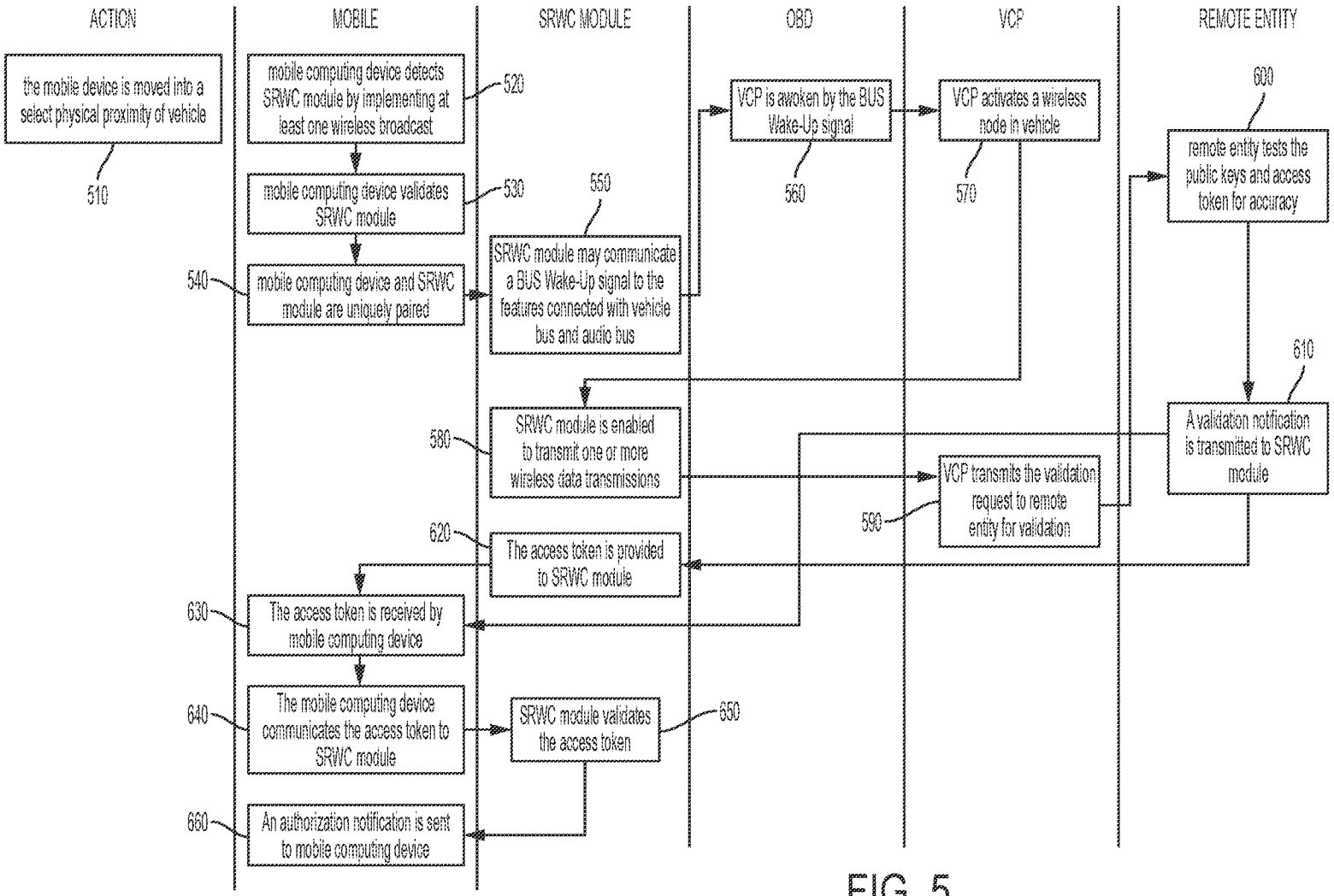
FIG. 5 is an exemplary flow diagram for executing vehicle functions via the mobile device.

FIG. 5 represents a method 500 for detection and authorization of an approaching mobile computing device 57 configured to complete reservation registration. In step 510, the mobile device 57 is moved into a select physical proximity of vehicle 12. In step 520, mobile computing device 57 detects SRWC module 74 by implementing at least one wireless broadcast (i.e., a sweep). SRWC module 74 may also be programmed to broadcast a challenge signal (which may include a corresponding UUID). In step 530, mobile computing device 57 validates SRWC module 74 (i.e., the UUID). In step 540, mobile computing device 57 and SRWC module 74 are uniquely paired and notification may be delivered to SRWC module 74.

In step 550, SRWC module 74 may communicate a BUS Wake-Up signal to the features connected with vehicle bus 32 and audio bus 22. In step 560, VCP 24 is awoken by the BUS Wake-Up signal. In step 570, VCP 24 activates a wireless node in vehicle 12. In step 580, SRWC module 74 is enabled to transmit one or more wireless data transmissions (i.e., Wi-Fi). In this step, optionally, VCP 24 and/or mobile computing device 57 may transmit a verification request to remote entity 54, so as to ensure that the token has not been previously revoked. In step 590, VCP 24 transmits the validation request to remote entity 54, for key or token validation. In step 600, upon receiving this validation request, remote entity 54 may test the first and public keys 27 and 29 as well as the access token for accuracy.

In step 610, a validation notification may be transmitted to SRWC module 74. In step 620, the access token is also provided to SRWC module 74. In addition, in step 630, the access token is received by mobile computing device 57. In step 640, mobile computing device 57 automatically communicates the access token to SRWC module 74. In step 650, SRWC module 74 validates the access token, via the digital signature and encrypted public keys (discussed above). In step 760, an authorization notification is sent to mobile computing device 57 to notify the user the unique paring process is complete (and thus CarShare App 86 can command vehicle 12).

Figure 6:
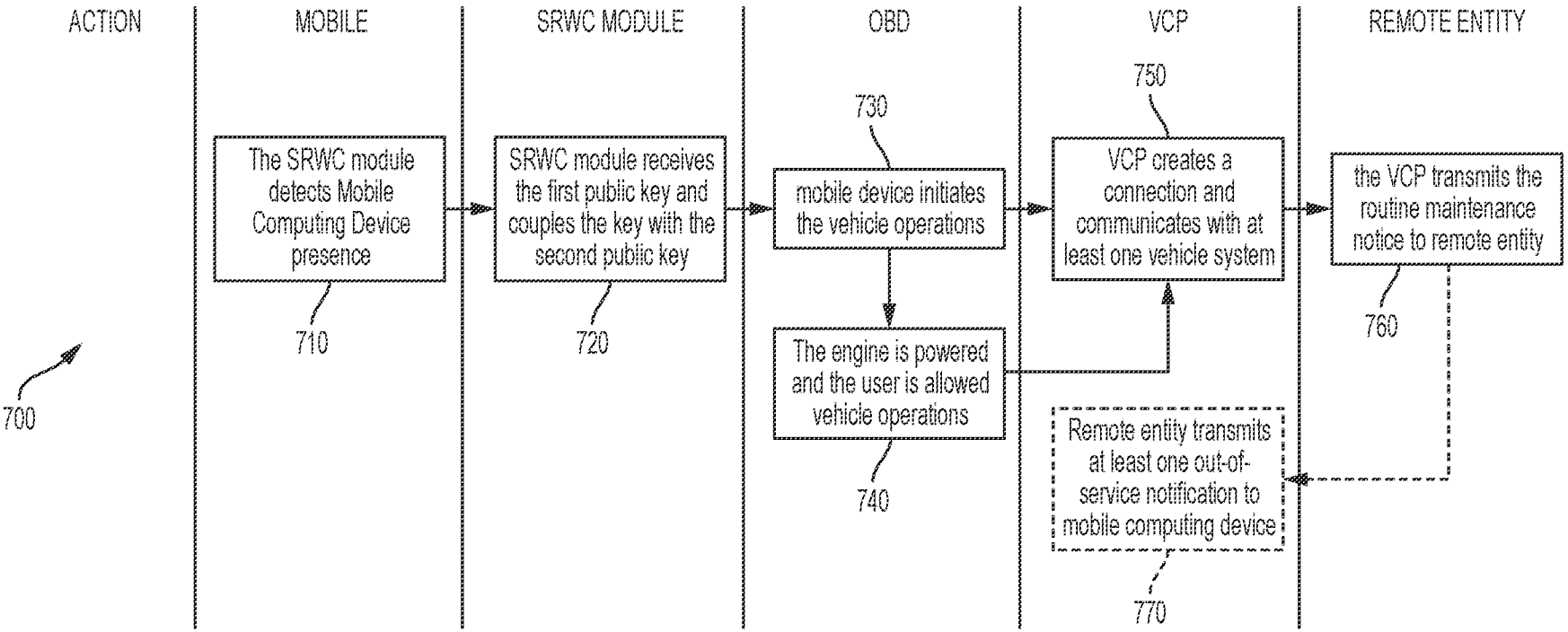
FIG. 6 is an exemplary flow diagram for executing additional vehicle functions of the vehicle.

FIG. 6 is a flow diagram for a method 700 for executing operational functions of the vehicle after authentication has been established. In step 710, once mobile computing device 57 is within the interior of vehicle 12, SRWC module 74 detects its presence (i.e., via an SRWC interior antenna 70). In step 720, SRWC module 74 receives the first public key 27 and couples the key with the second public key 29. The authorization keys are then transmitted to remote entity 54. In turn, remote entity 54 enables mobile device 57 (i.e., CarShare App 86) to operate vehicle 12. In step 730, mobile device 57 initiates the vehicle operations. It should be understood that PEPS functionality may be executed by authorizing vehicle engine access, as would be performed during a typical PEPS operation. In step 740, the engine is powered and the user is allowed to drive the vehicle.

In step 750, while in operation, VCP 24 creates a connection and communicates with OMM 44, BCM 44, OBD systems, odometer/milometer (or other vehicle systems) to receive and compile certain vehicle-maintenance-type information. The vehicle information may be received in an on-going basis or as a one-time event. For example, VCP 24 could routinely communicate with OMM 44 to receive updated vehicle oil information such as, but not limited to, oil life information and filter health information. In another example, VCP 24 could communicate with the OBD systems to receive an anomalous indication that the malfunction indication light (MIL) has initiated on the vehicle dash, and/or receive an indication that there has been a vehicle component failure, and/or receive an indication that there has been a self-diagnostics notification. In yet another example, VCP 24 could routinely communicate with the odometer/milometer and receive an indication that vehicle 12 has surpassed a certain mileage. It should be understood that it has been envisioned VCP 24 can communicate with other vehicle sensors 44 to receive indications of other vehicle-maintenance-type information. It has been envisioned that vehicle-maintenance-type information is vehicle systems information (sensor information) which is in regard to care or upkeep of the vehicle and engine.

Based upon the vehicle information, VCP 24 can compile the vehicle information and subsequently generate one or more routine maintenance notices. For example, when the maintenance notice pertains to vehicle oil, the notice can include data regarding the time/quantity of vehicle oil remaining. The notice could moreover include data regarding whether the oil filter has completely failed. In another example, when the maintenance notice pertains to a vehicle component failure or self-diagnostics notification, the notice could include data regarding the specific component which has failed or which component/system of components triggered the self-diagnostics notification. In yet another example, when the maintenance notice pertains to mileage information, the notice could include data regarding the exact mileage reached or the mileage past a certain milestone (e.g., last oil change). It should be appreciated that one or more aspects of step 750 may include one or more code segments (software algorithms) of VCP 24 creating a data file (temporary or permanent) within electronic memory 40 for the purposes of storing the pre/post-compiled information. In certain instances, VCP 24 can take vehicle location information from GNSS chipset/component 42 and compile the information into the other vehicle information. This will allow vehicle location to be factored into the maintenance notice.

In step 760, VCP 24 transmits the routine maintenance notice to remote entity 54. Upon receiving this notice, remote entity 24 may be triggered to employ one or more of the back-end functions to review and analyze the notice information. Once adequate review and analysis is complete, remote entity 54 may proactively predict when vehicle 12 will require future maintenance. As such, in accordance with these maintenance predictions, remote entity 54 will automatically modify the vehicle registration status for a selected time duration (e.g., via the vehicle reservation calendar) as being "out of service" (or a similar status), to restrict users from reserving the vehicle during this time duration and allow time for the occurrence of at least one maintenance event.

Remote entity 54 may also automatically transmit a derived maintenance notification to a selected facility 82 in the facility system to schedule the maintenance event for vehicle 12. The facility 82 may be selected based on a number of factors such as, but not limited to, maintenance specialties, technician availability, and facility capacity. In those instances of which the maintenance notification includes vehicle location information, remote entity 54 may select facility 82 from the system based on its location in relation to vehicle. Remote entity 54 may otherwise select facility 82 based on the probable location in which vehicle 12 is calculated to be situated at the predicted time of future maintenance. Such a calculation may be based upon the recorded number of times the vehicle has been at a particular reservable parking space, the recorded driving patterns of the vehicle, and up-to-date vehicle reservation calendar information. Furthermore, the maintenance notification will allow technician 84 to know when they should expect to conduct routine maintenance services on vehicle 12 (e.g., an oil change/filter replacement), and the notification may also explain the detailed specifics of the maintenance event services.

In optional step 770, remote entity 54 may further use the reviewed and analyzed information to derive and transmit at least one out-of-service notification to mobile computing device 57 (i.e., CarShare App 86). The out-of-service notification will allow users to view blocks of time that they cannot reserve vehicle 12, due to the scheduled maintenance event at facility 82. Such users may additionally get directed to other similarly located vehicles in the vehicle-share system 10. Furthermore, upon completion of the maintenance event or at time slots before and after the scheduled maintenance event, an "available-for-reservation" status (or other similar status) may be automatically designated in the vehicle reservation calendar for viewing through the CarShare App 86. The out-of-service notification may also be reactively generated upon a user requesting a vehicle registration during one or more time slots designated as being out-of-service.

During optional step 770, remote entity 54 may further provide the out-of-service notification to VCP 24 to assist the vehicle driver. VCP 24 may also implement display 39 and/or audio system 64 (e.g., via infotainment center console, instrument panel, IVVM, etc.) to exhibit the out-of-service designation notification. The out-of-service notification may, for example, provide a notification to the user that the vehicle cannot be reserved due to maintenance issues such as, but not limited to, oil life being below a certain threshold (e.g., 5%, 2%) and/or oil filter health being in failing health. Vehicle engine may also be remotely deactivated so that users cannot operate vehicle 12 until the maintenance event is complete. Such remote deactivation may be completed by known methodologies and which may be conducted through remote entity 54 and/or other features of call center 18.

It should be appreciated that a technician 84 may operate vehicle 12 and take it to the maintenance event at the selected facility 82 in the system. The out-of-service notification may further provide a destination incentive that incentivizes the current user to take vehicle 12 to a selected facility 82 in the system. The out-of-service notification may, for example, provide an incentive offer in which the user will earn credit that can be used towards their current reservation and/or a future reservation (e.g., a 50% cost reduction, an additional two (2) hours of allotted reservation time, etc.). Such incentives may, for example, be helpful to incentivize users with allotted reservation end times which abut the out-of-order time slots in the vehicle reservation calendar. While at the selected facility 82, the user may moreover receive another vehicle 12 to complete their reservation. In certain instances, the destination incentive may also allow the current user to select one of the facilities 82 in the system, to allow the user to have the ability of choice.

Figure 7:
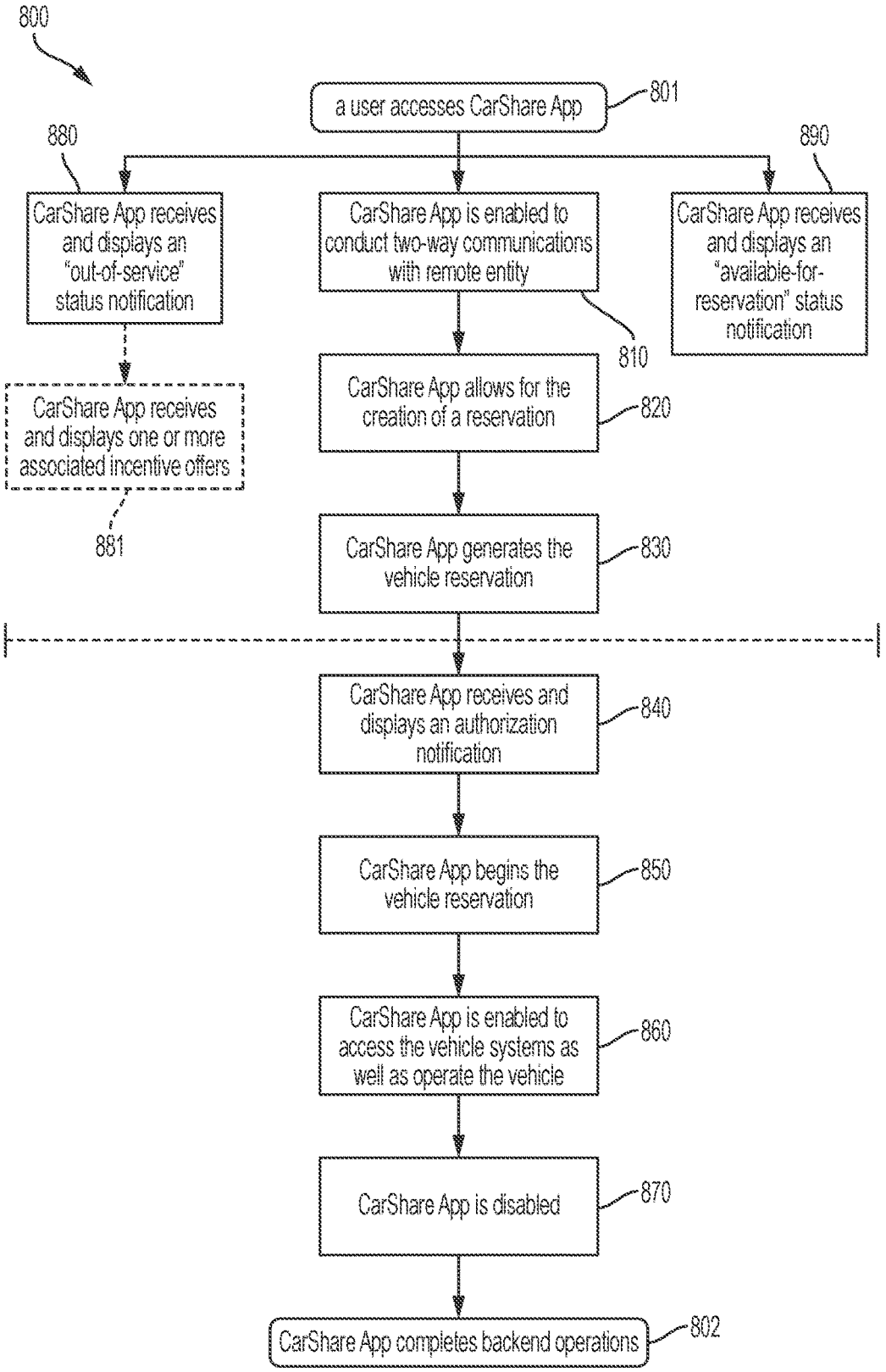
FIG. 7 is an exemplary flow diagram for an aspect of a CarShare App embodiment.

FIG. 7 is an algorithmic flow diagram for an exemplary embodiment of the CarShare App algorithm 800 for the CarShare App 86, discussed above, and which may be incorporated into to an embodiment of the system and method presented herein. One or more aspects of algorithm 800 may be completed through the implementation of the mobile processor of mobile computing device 57, which may include one or more executable code segments/instructions (software algorithms) incorporated into mobile memory storage 61 and may be executed by a user that can navigate algorithm 800 through user interface 59. One or more aspects of method 800 may moreover be implemented by remote entity 54 of data center 18 which may include one or more executable code segments/instructions (software algorithms) incorporated into database 56 and executed by mobile device 57 (which may be transmitted via one or more satellites 62). It should be further appreciated that steps of this algorithmic flow process may include an order of which is not presented as described herein. Other algorithmic steps may moreover be incorporated before or after or between any of the herein presented steps.

As shown, algorithm 800 begins at step 801 which may occur when a user of mobile device 57 accesses CarShare App 86 from mobile memory storage 61, via one of a number of generally known methodologies. In step 810, CarShare App 86 is enabled to conduct two-way communications with remote entity 54 (i.e., via data transmissions send over wireless communication system 14). In step 820, CarShare App 86 allows for the creation of a vehicle reservation which may essentially reserve to hold a vehicle 12 (configured to operate in vehicle-share system 10), which may be located at a specific parking location and may be for a certain duration of time (discussed above). In step 830, CarShare App 86 generates the vehicle reservation. In this step, CarShare App 86 may also transmit the vehicle reservation to remote entity. Such a transmission may occur at the moment of the vehicle reservation creation or at some point in time thereafter.

As displayed by the broken line, steps 840 through 870 occur at the point in time after the beginning of vehicle reservation. In step 840, CarShare App 86 receives and displays an authorization notification (i.e., via user interface 59). It should be appreciated this step may occur only after the unique pairing is complete, for example, after the digital signature and encrypted public keys are validated (discussed above). If such validation does not occur, for security purposes, algorithm 800 may simply move to step 802 and complete operations. In such an instance, for protective purposes, algorithm 800 may also disable certain functions of CarShare App 86 (i.e., locking user out of further CarShare App 86 usage). In step 850, CarShare App 86 begins the vehicle reservation (discussed above). In step 860, CarShare App 86 is enabled to access the vehicle systems as well as operate the vehicle (discussed above). Such enablement may be commanded by remote entity 54. At step 870, CarShare App 86 is disabled from accessing the vehicle systems as well as operating the vehicle (discussed above). At step 802, CarShare App 86 completes its backend operations to end the current usage scheme.

Steps 880 through 890 may occur concurrently with any of the preceding steps or at any time before or after such steps. At step 880, CarShare App 86 receives and displays an "out-of-service" status notification or a similar status (i.e., via user interface 59), as discussed above. As can be inferred from the above, this status may automatically modify one or more aspects of the GUIs of the CarShare App 86 (displayed on user interface 59). At optional step 881, CarShare App 86 may further receive and display one or more an incentive offers associated with the "out-of-service" status notification, as discussed above. At step 890, CarShare App 86 receives and displays an "available-for-reservation" status notification or a similar status (i.e., via user interface 59). As can be inferred from the above, this status may automatically modify the GUI embodied version of the reservation calendar which is transferred to mobile device 57 and displayed on user interface 59.

A step-by-step discussion of a method to manage the routine maintenance of a vehicle 12 that has been incorporated in a vehicle-share system. In a first step, VCP 24 receives one or more communications from the vehicle system. Next, in a second step, VCP 24 generates a routine maintenance notice, which is derived from the vehicle system communication. In a third step, VCP 24 will transmit the routine maintenance notice to the remote entity. In a fourth step, remote entity 54 will receive the routine maintenance notice. In a fifth step, remote entity 54 will implement its back-end functions to review and analyze the routine maintenance notice. In a sixth step, remote entity 54 will predict future maintenance of the vehicle 12 from the routine maintenance notice analysis. In a final step, remote entity 54 will modify the vehicle registration status in the database and this will allow for a maintenance event. It should be appreciated aspects of each step are discussed above in further detail.

The processes, methods, or algorithms disclosed herein can be deliverable to/implemented by a processing device, controller, or computer, which can include any existing programmable electronic control unit or dedicated electronic control unit. Similarly, the processes, methods, or algorithms can be stored as data and instructions executable by a controller or computer in many forms including, but not limited to, information permanently stored on non-writable storage media such as ROM devices and information alterably stored on writeable storage media such as floppy disks, magnetic tapes, CDs, RAM devices, and other magnetic and optical media. The processes, methods, or algorithms can also be implemented in a software executable object. Alternatively, the processes, methods, or algorithms can be embodied in whole or in part using suitable hardware components, such as Application Specific Integrated Circuits (ASICs), Field-Programmable Gate Arrays (FPGAs), state machines, controllers or other hardware components or devices, or a combination of hardware, software and firmware components. Such example devices may be on-board as part of a vehicle computing system or be located off-board and conduct remote communication with devices on one or more vehicles.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further exemplary aspects of the present disclosure that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A system to manage the routine maintenance of a vehicle incorporated in a vehicle-share system, the maintenance management system comprising:

a vehicle configured to be incorporated in the vehicle-share system, the vehicle comprising at least one vehicle sensor and a short-range wireless connection (SRWC) module;

wherein the vehicle-share system is configured to allow a system user to reserve the vehicle through a mobile computing device, and the vehicle-share system is additionally configured to pair the mobile computing device to the SRWC module such that one or more vehicle functions may be commanded by the mobile computing device;

a GNSS chipset/component, the GNSS chipset/component configured to provide vehicle location information;

a vehicle communication platform (VCP) located within the vehicle, the VCP configured to communicate with the vehicle sensor, the VCP configured to generate and communicate a data transmission;

a remote entity comprising at least one database incorporating vehicle reservation calendar information, the remote entity configured to receive the VCP data transmission, the remote entity configured to transmit at least one encrypted digital key to each of the mobile computing device and SRWC module to enable the mobile computing device to command the one or more vehicle functions when paired to the SRWC module;

a plurality of maintenance facilities each of which being configured to provide routine vehicle maintenance services;

wherein the vehicle reservation calendar information is configured to establish a virtual calendar having numerous designatable time durations to enable system users to reserve the vehicle for one or more of the time durations;

wherein the VCP collaborates with the vehicle sensor to generate at least one routine maintenance notice, the VCP subsequently transmits the routine maintenance notice to the remote entity;

wherein, upon review and analysis of the routine maintenance notice, the remote entity will predict future maintenance of the vehicle and modify the vehicle registration status in the database for one or more of the time durations via the vehicle reservation calendar so as to restrict system users from reserving the vehicle during those one or more time durations and allow for a maintenance event;

wherein the VCP collaborates with the GNSS chipset/component to generate at least one vehicle location notice comprising vehicle location information, the VCP subsequently transmits the vehicle location notice to the remote entity; and wherein, upon review and analysis of the vehicle location notice and routine maintenance notice, the remote entity will select one maintenance facility from the plurality of maintenance facilities based on the vehicle location in relation to the location of each maintenance facility of the plurality of maintenance facilities, generate a maintenance notification, and transmit the maintenance notification to the selected maintenance facility to schedule the maintenance event at the selected maintenance facility.

2. The maintenance management system of claim 1, further comprising:

the mobile computing device comprising a CarShare App, wherein the mobile computing device configured to pair to the SRWC module such that vehicle functions can be commanded by the mobile computing device via the CarShare App; and wherein the remote entity generates and transmits an out-of-service notification to the CarShare App.

3. The maintenance management system of claim 2, wherein the out-of-service notification comprises an incentive offer.

4. The maintenance management system of claim 1, wherein the remote entity generates and transmits an out-of-service notification to the VCP configured to be exhibited on a display of the VCP to notify the system user that the vehicle cannot be reserved due to maintenance issues.

5. The maintenance management system of claim 4, wherein the out-of-service notification comprises an incentive offer.

6. The maintenance management system of claim 1, wherein the routine maintenance notice comprises remaining oil time/quantity information, oil filter failure information, component failure information, self-diagnostic information, mileage information, or some combination thereof.

7. A method to manage the routine maintenance of a vehicle incorporated in a vehicle-share system, the maintenance management method comprising:

(a) providing a vehicle configured to be incorporated in the vehicle-share system, the vehicle comprising at least one vehicle sensor and a short-range wireless connection (SRWC) module, wherein the vehicle-share system is configured to allow a system user to reserve the vehicle through a mobile computing device, and the vehicle-share system is additionally configured to pair the mobile computing device to the SRWC module such that one or more vehicle functions may be commanded by the mobile computing device;

(b) providing a vehicle communication platform (VCP) located within the vehicle, the VCP configured to communicate with the vehicle sensor, the VCP configured to generate and communicate at least one data transmission;

(c) providing a remote entity comprising a database incorporating vehicle reservation calendar information, the remote entity configured to receive the VCP data transmission, the remote entity configured to transmit at least one encrypted digital key to each of the mobile computing device and SRWC module to enable the mobile computing device to command the one or more vehicle functions when paired to the SRWC module, wherein the vehicle reservation calendar information is configured to establish a virtual calendar having numerous designatable time durations to enable system users to reserve the vehicle for one or more of the time durations;

(d) receiving, at the VCP, at least one communication from the vehicle sensor;

(e) generating, via the VCP, at least one routine maintenance notice derived from the vehicle sensor communication;

(f) transmitting, via the VCP, the routine maintenance notice to the remote entity;

(g) receiving, at the remote entity, the routine maintenance notice;

(h) implementing a back-end function, via the remote entity, to review and analyze the routine maintenance notice;

(i) predicting, via the remote entity, future maintenance of the vehicle from the routine maintenance notice analysis; and (j) modifying, via the remote entity, the vehicle registration status in the database for one or more of the time durations via the vehicle reservation calendar so as to restrict system users from reserving the vehicle during those one or more time durations and allow for a maintenance event (k) providing a plurality of maintenance facilities each of which being configured to provide routine vehicle maintenance services;

(l) providing a GNSS chipset/component located in the vehicle, the GNSS chipset/component configured to provide vehicle location information;

(m) generating, via the remote entity, a maintenance notification derived from the maintenance notice analysis;

(n) selecting, via the remote entity, one maintenance facility from the plurality of maintenance facilities based on the vehicle location in relation to the location of each maintenance facility of the plurality of maintenance facilities;

(o) transmitting, via the remote entity, the maintenance notification to the selected maintenance facility; and (p) scheduling at the selected maintenance facility, via the remote entity, the maintenance event.

8. The maintenance management method of claim 7, the method further comprising:

(q) providing the mobile computing device comprising a CarShare App, wherein the mobile computing device is configured to pair with the SRWC module such that the vehicle functions can be commanded by the mobile computing device via the CarShare App;

(r) generating, via the remote entity, an out-of-service notification;

(s) transmitting, via the remote entity, the out-of-service notification to the CarShare App; and (t) exhibiting, via the CarShare App, the out-of-service notification.

9. The maintenance management method of claim 8, wherein the out-of-service notification comprises an incentive offer.

10. The maintenance management method of claim 7, the method further comprising:

(q) generating, via the remote entity, an out-of-service notification configured to be exhibited on a display of the VCP to notify the system user that the vehicle cannot be reserved due to maintenance issues; and (r) transmitting, via the remote entity, the out-of-service notification to the VCP.

11. The maintenance management method of claim 10, wherein the out-of-service notification comprises an incentive offer.

12. The maintenance management method of claim 7, wherein the routine maintenance notice comprises remaining oil time/quantity information, oil filter failure information, component failure information, self-diagnostic information, mileage information, or some combination thereof.

13. A method to manage the routine maintenance of a vehicle incorporated in a vehicle-share system, the maintenance management method comprising:

(a) providing a vehicle configured to be incorporated in the vehicle-share system, the vehicle comprising an oil monitoring module (OMM) and a short-range wireless connection (SRWC) module, wherein the vehicle-share system is configured to allow a system user to reserve the vehicle through a mobile computing device, and the vehicle-share system is additionally configured to pair the mobile computing device to the SRWC module such that one or more vehicle functions may be commanded by the mobile computing device;

(b) providing a vehicle communication platform (VCP) located within the vehicle, the VCP configured to communicate with the OMM, the VCP configured to generate and communicate at least one data transmission;

(c) providing a remote entity comprising a database incorporating vehicle reservation calendar information, the remote entity configured to receive the VCP data transmission, wherein the vehicle reservation calendar information is configured to establish a virtual calendar having numerous designatable time durations to enable system users to reserve the vehicle for one or more of the time durations;

(d) providing a GNSS chipset/component located in the vehicle, the GNSS chipset/component configured to provide vehicle location information to the VCP;

(e) providing a plurality of maintenance facilities each of which being configured to provide routine vehicle maintenance services;

(f) receiving, at the VCP, a vehicle oil information communication from the OMM;

(g) generating, via the VCP, at least one routine maintenance notice derived from the vehicle oil information;

(h) transmitting, via the VCP, the routine maintenance notice to the remote entity;

(i) receiving, at the VCP, vehicle location information from the GNSS chipset/component;

(j) transmitting, via the VCP, the vehicle location information to the remote entity;

(k) receiving, at the remote entity, the routine maintenance notice and the vehicle location information;

(l) implementing a back-end function, via the remote entity, to review and analyze the routine maintenance notice;

(m) predicting, via the remote entity, future maintenance of the vehicle from the routine maintenance notice analysis;

(n) modifying, via the remote entity, the vehicle registration status in the database for one or more of the time durations via the vehicle reservation calendar so as to restrict system users from reserving the vehicle during those one or more time durations and allow for a maintenance event;

(o) generating, via the remote entity, a maintenance notification derived from the maintenance notice analysis;

(p) selecting, via the remote entity, one maintenance facility from the plurality of maintenance facilities based on the vehicle location in relation to the location of each maintenance facility of the plurality of maintenance facilities;

(q) transmitting, via the remote entity, the maintenance notification to the selected maintenance facility; and (r) scheduling at the selected maintenance facility, via the remote entity, the maintenance event.

14. The maintenance management method of claim 13, the method further comprising:

(s) providing the mobile computing device comprising a CarShare App, wherein the mobile computing device is configured to pair with the SRWC module such that the vehicle functions can be commanded by the mobile computing device via the CarShare App;

(t) generating, via the remote entity, an out-of-service notification;

(u) transmitting, via the remote entity, the out-of-service notification to the CarShare App; and (v) exhibiting, via the CarShare App, the out-of-service notification.

15. The maintenance management system of claim 1, wherein the selection of the one maintenance facility from the plurality of maintenance facilities is further based on the maintenance specialties, technician availability, and facility capacity for each maintenance facility of the plurality of maintenance facilities.

16. The maintenance management method of claim 7, wherein the step of selecting the one of the maintenance facilities from the plurality of maintenance facilities is further based on the maintenance specialties, technician availability, and facility capacity for each maintenance facility of the plurality of maintenance facilities.

17. The maintenance management method of claim 13, wherein the step of selecting the one of the maintenance facilities from the plurality of maintenance facilities is further based on the maintenance specialties, technician availability, and facility capacity for each maintenance facility of the plurality of maintenance facilities.

18. The maintenance management system of claim 1, wherein the maintenance notification is further configured to allow a technician located at the selected maintenance facility to know when to conduct maintenance services on the vehicle as well as explain the detailed specifics of the maintenance event.

19. The maintenance management method of claim 7, wherein the maintenance notification is further configured to allow a technician located at the selected maintenance facility to know when to conduct maintenance services on the vehicle as well as explain the detailed specifics of the maintenance event.

20. The maintenance management method of claim 13, wherein the maintenance notification is further configured to allow a technician located at the selected maintenance facility to know when to conduct maintenance services on the vehicle as well as explain the detailed specifics of the maintenance event.

* * * * *